US010677524B2

(12) United States Patent
Rowe

(10) Patent No.: US 10,677,524 B2
(45) Date of Patent: Jun. 9, 2020

(54) SYSTEM AND METHOD FOR LIQUEFYING PRODUCTION GAS FROM A GAS SOURCE

(71) Applicant: Geoff Rowe, Red Deer (CA)

(72) Inventor: Geoff Rowe, Red Deer (CA)

( * ) Notice: Subject to any disclaimer, the term of this patent is extended or adjusted under 35 U.S.C. 154(b) by 361 days.

(21) Appl. No.: 15/484,273

(22) Filed: Apr. 11, 2017

(65) Prior Publication Data

US 2017/0292784 A1 Oct. 12, 2017

(30) Foreign Application Priority Data

Apr. 11, 2016 (CA) ..... 2926892

(51) Int. Cl.
*F25J 1/00* (2006.01)
*C10L 3/12* (2006.01)
(Continued)

(52) U.S. Cl.
CPC ..... *F25J 1/0022* (2013.01); *C10L 3/10* (2013.01); *C10L 3/12* (2013.01); *F25J 1/0052* (2013.01);
(Continued)

(58) Field of Classification Search
CPC .. F25J 1/0022; F25J 2210/60; F25J 2270/902; F25J 2210/42; F25J 2220/64;
(Continued)

(56) References Cited

U.S. PATENT DOCUMENTS 2,666,019 A * 1/1954 Steffens ..... C10G 7/02 208/351
2,973,834 A * 3/1961 Cicalese ..... C07C 7/00 95/193
(Continued)

FOREIGN PATENT DOCUMENTS

WO 2006087331 A1 8/2006
WO 2015160593 A1 10/2015

OTHER PUBLICATIONS

International Search Report issued in corresponding International Patent Application No. PCT/CA2017/050434 dated Jul. 21, 2017.

*Primary Examiner* — Ljiljana V. Ciric
(74) *Attorney, Agent, or Firm* — Davis & Bujold PLLC; Michael J. Bujold

(57) ABSTRACT

A system for liquefying production gas from a gas source containing a fluid having C1-C12 entrained gases includes a first phase separator for separating the C1-C12 gases from the fluid from the gas source. The first phase separator has an inlet in fluid communication with the gas source, a gas outlet and at least one alternative outlet. A first cryogenic liquefaction vessel has an inlet and an outlet. The inlet is in fluid communication with the gas outlet of the first phase separator. The first cryogenic liquefaction vessel cools the C1-C12 gases to liquefy the C3-C12 petroleum gases. A second phase separator is provided for separating the C3-C12 liquefied gases from the C1-C2 gases. The second phase separator has an inlet, a liquid outlet and a gas outlet. The inlet is in fluid communication with the outlet of the first cryogenic liquefaction vessel. At least one storage vessel is provided in fluid communication with the liquid outlet of the second phase separator for collection of the liquefied C3-C12 petroleum gases.

17 Claims, 6 Drawing Sheets

(51) Int. Cl.
*F25J 1/02* (2006.01)
*C10L 3/10* (2006.01)

(52) U.S. Cl.
CPC ..... *F25J 1/0212* (2013.01); *F25J 1/0221* (2013.01); *F25J 1/0222* (2013.01); *F25J 1/0256* (2013.01); *F25J 2210/42* (2013.01); *F25J 2210/60* (2013.01); *F25J 2220/64* (2013.01); *F25J 2270/902* (2013.01); *F25J 2290/62* (2013.01)

(58) Field of Classification Search
CPC ..... F25J 2290/62; F25J 1/0052; F25J 1/0212; F25J 1/0221; F25J 1/0222; F25J 1/0256; C10L 3/10; C10L 3/12
See application file for complete search history.

(56) References Cited

U.S. PATENT DOCUMENTS 3,358,461 A * 12/1967 Hendrix ..... C10G 5/04 62/635
3,932,156 A * 1/1976 Stern ..... F25J 3/061 62/634
4,430,103 A 2/1984 Gray et al.
4,443,238 A 4/1984 Beddome et al.
4,445,917 A 5/1984 Chiu
4,479,871 A * 10/1984 Pahade ..... C10G 5/00 208/340
4,705,549 A * 11/1987 Sapper ..... C07C 7/005 208/341
4,707,171 A * 11/1987 Bauer ..... C07C 7/005 208/341
4,829,785 A 5/1989 Hersey
RE33,408 E * 10/1990 Khan ..... C07C 7/09 62/621
4,970,867 A * 11/1990 Herron ..... F25J 1/0022 62/613
5,090,977 A * 2/1992 Strack ..... C10G 70/02 208/351
5,157,925 A * 10/1992 Denton ..... F25B 1/10 62/335
5,325,673 A * 7/1994 Durr ..... C10G 5/06 62/634
5,365,740 A * 11/1994 Kikkawa ..... F25J 1/0022 165/166
5,377,490 A * 1/1995 Howard ..... C07C 7/04 62/623
5,379,597 A * 1/1995 Howard ..... C07C 7/04 62/612
5,755,114 A 5/1998 Foglietta
6,016,665 A 1/2000 Cole et al.
6,250,105 B1 6/2001 Kimble
6,269,655 B1 * 8/2001 Roberts ..... F25J 1/0022 62/612
6,347,532 B1 * 2/2002 Agrawal ..... F25J 1/0214 62/612
6,622,496 B2 9/2003 Cheng et al.
6,658,891 B2 12/2003 Reijnen et al.
6,763,680 B2 7/2004 Fischer et al.
6,907,752 B2 6/2005 Schroeder et al.
7,263,845 B2 9/2007 Lee
8,381,544 B2 2/2013 Coyle
8,794,319 B2 8/2014 Cerenzie
10,107,549 B2 * 10/2018 Bonnissel ..... F25J 1/0022
2007/0227185 A1 * 10/2007 Stone ..... F25J 1/0092 62/611
2009/0241593 A1 * 10/2009 Jager ..... F25J 1/0022 62/613
2010/0107686 A1 5/2010 Bras et al.
2012/0017639 A1 * 1/2012 Peterson ..... C10L 3/02 62/611
2012/0096895 A1 4/2012 Patel et al.
2014/0144178 A1 5/2014 Terrien et al.
2014/0190205 A1 7/2014 Bonnissel et al.
2014/0283548 A1 9/2014 He et al.
2015/0013378 A1 1/2015 He et al.
2015/0184930 A1 * 7/2015 Bonnissel ..... F25J 1/0022 62/611
2016/0003527 A1 1/2016 Dean et al.
2017/0356677 A1 * 12/2017 Rowe ..... F25B 9/002

* cited by examiner

SYSTEM AND METHOD FOR LIQUEFYING PRODUCTION GAS FROM A GAS SOURCE

FIELD OF THE DISCLOSURE

The present application relates generally to a system and method for liquefying production gas from a gas source.

BACKGROUND

This section provides background information to facilitate a better understanding of the various aspects of the invention. It should be understood that the statements in this section of this document are to be read in this light, and not as admissions of prior art.

C1-C12 gases are present in many different types of gas sources. In order to recover and utilize these gases, they must first be separated out of the medium in which they are found. This can be a costly and inefficient process with valuable natural and petroleum gases being flared off or left in fluid suspension and not utilized or properly accredited for their commodity values.

BRIEF SUMMARY

There is provided a method for liquefying production gas from a gas source that includes the steps of introducing flow streams from the gas source into a first phase separator to separate the C1-C12 production gases from the flow stream. The gas from the first phase separator is passed through a first stage of cryogenic liquefaction which cools the gas to create a fluid containing liquefied C3-C12 petroleum gas and a gaseous C1-C2 natural gas. The fluid containing liquefied C3-C12 petroleum gas and a gaseous C1-C2 natural gas is passed through a second phase separator to separate the liquefied C3-C12 petroleum gas from the gaseous C1-C2 natural gas. The C3-C12 petroleum gas can then be collected into at least one liquefied petroleum gas storage vessel.

In one embodiment, the method for liquefying production gas from a gas source includes the additional steps of passing the gaseous C1-C2 natural gas from the second phase separator through a second stage of cryogenic liquefaction. This causes the C1-C2 natural gas to be liquefied. The liquefied C1-C2 natural gas is then collected into at least one C1-C2 liquefied natural gas storage vessel.

In another embodiment, the first stage of cryogenic liquefaction cools the gas to between −42 and −126 degrees Celsius to cause liquefaction of the C3-C12 production gases.

In another embodiment, the second stage of cryogenic liquefaction cools the gaseous C1-C2 natural gas to at least −162 degrees Celsius to create liquefied C1-C2 natural gas.

In another embodiment, the method for liquefying production gas from a gas source includes a step of passing the flow stream from the gas source into a sand catcher before injecting the flow stream into the first phase separator.

In another embodiment, a booster is used between the gas source and the first phase separator. The booster is used to increase the pressure or volume of fluids and gasses coming from the gas source and entering the first phase separator.

In one embodiment, liquid nitrogen is used during cryogenic liquefaction. In another embodiment, glycol that has been cooled by liquid nitrogen is used during cryogenic liquefaction. Generally, glycol is used where there is likely to be an adverse reaction with the nitrogen during cryogenic liquefaction.

In another embodiment, the first stage of cryogenic liquefaction occurs in a first plate exchanger. The second stage of cryogenic liquefaction may occur in a second plate exchanger.

In another embodiment, a scavenger is injected into the fluid stream prior to the fluid passing through the inlet of the first phase separator. Scavenger may be injected into the fluid stream prior to the fluid passing through the inlet of the second phase separator. The scavenger is used to entrain H2S within the fluid stream so that the sulfur is non-reactive during the liquefaction process.

In one embodiment, at least one of the C1-C2 liquid natural gas storage vessels may be depressurized when the Reid vapor pressure reaches a predetermined level. The predetermined level may be determined by the user. The C1 and C2 is then reintroduced into the gas stream prior to either the first stage of cryogenic liquefaction or the second stage of cryogenic liquefaction. The decision to reintroduce the C1 and C2 into either the first stage of cryogenic liquefaction or the second stage of cryogenic liquefaction can be determined to maximize the efficiency of the system. This can be accomplished through the application of a boost pump to achieve feed pressure back into the system.

In one embodiment, at least one of the C3-C12 liquid natural gas storage vessels may be depressurized when the Reid vapor pressure reaches a predetermined level. The predetermined level may be determined by the user. The C3-C12 is then reintroduced into the gas stream prior to the first stage of cryogenic liquefaction. This can be accomplished through the application of a boost pump to achieve feed pressure back into the system.

There is also provided a system for liquefying production gas from a gas source that contains a fluid having C1-C12 entrained gases. A 3-phase separator is provided for separating water, oil and gas from the fluid. The 3-phase separator has an inlet in fluid communication with the gas source, a water outlet, an oil outlet and a gas outlet. A first cryogenic liquefaction vessel has an inlet and an outlet with the inlet being in fluid communication with the gas outlet of the 3-phase separator. The first cryogenic liquefaction vessel cools the C1-C12 gases to liquefy the C3-C12 petroleum gases. A second phase separator is provided for separating the C3-C12 liquefied gases from the C1-C2 gases. The second phase separator has an inlet, a liquid outlet and a gas outlet with the inlet being in fluid communication with the outlet of the first cryogenic liquefaction vessel. Storage vessels are provided in fluid communication with the liquid outlet of the second phase separator for collection of the liquefied C3-C12 petroleum gases.

In one embodiment, the system for liquefying production gas from a gas source also has a second cryogenic liquefaction vessel to liquefy the C1-C2 gases separated by the second phase separator. The second cryogenic liquefaction vessel has an inlet and an outlet with the inlet being in fluid communication with the gas outlet of the second phase separator and the outlet being in fluid communication with at least one storage vessel for collection of the liquefied C1-C2 gases.

In an alternate embodiment, the gas outlet of the second phase separator is in fluid communication with a pipeline.

In a further embodiment, the gas outlet of the second phase separator is in fluid communication with a flare stack.

In another embodiment, the first stage of cryogenic liquefaction cools the gas to between −42 and −126 degrees Celsius to cause liquefaction of the C3-C12 production gases.

In another embodiment, the second stage of cryogenic liquefaction cools the gaseous C1-C2 natural gas to at least −162 degrees Celsius to create liquefied C1-C2 natural gas.

In another embodiment, the first stage of cryogenic liquefaction occurs in a first plate exchanger. The second stage of cryogenic liquefaction may occur in a second plate exchanger.

In another embodiment, a sand catcher is positioned between the gas source and the 3-phase separator. The sand catcher has an inlet in fluid communication with the gas source and a fluid outlet in fluid communication with the inlet of the 3-phase separator.

In another embodiment, a first pressure relief line is provided between the 3-phase separator and the first cryogenic liquefaction vessel.

In another embodiment, a second pressure relief line is provided after the gas outlet of the second phase separator.

In another embodiment, the first pressure relief line and the second pressure relief line are in fluid communication with at least one flare stack.

In one embodiment, a return line is provided between the C1-C2 storage vessels and the second cryogenic liquefaction vessel for reintroducing C1-C2 into the second cryogenic liquefaction vessel.

In one embodiment, a return line is provided between the C1-C2 storage vessels and the first cryogenic liquefaction vessel for reintroducing C1-C2 into the first cryogenic liquefaction vessel.

In one embodiment, a return line is provided between the C3-C12 storage vessels and the first cryogenic liquefaction vessel for the reintroduction of C3-C12 into the first cryogenic liquefaction vessel.

There is also provided a system for liquefying production gas from a gas source containing a fluid having C1-C12 entrained gases. A first phase separator for separating the C1-C12 gases from the fluid from the gas source is provided. The first phase separator has an inlet in fluid communication with the gas source, a gas outlet and at least one alternative outlet. A first cryogenic liquefaction vessel has an inlet and an outlet. The inlet is in fluid communication with the gas outlet of the first phase separator. The first cryogenic liquefaction vessel cools the C1-C12 gases to liquefy the C3-C12 petroleum gases. A second phase separator is provided for separating the C3-C12 liquefied gases from the C1-C12 gases. The second phase separator has an inlet, a liquid outlet and a gas outlet. The inlet is in fluid communication with the outlet of the first cryogenic liquefaction vessel. At least one storage vessel is provided in fluid communication with the liquid outlet of the second phase separator for collection of the liquefied C3-C12 petroleum gases.

In one embodiment, the first phase separator is a 3-phase separator and the alternative outlet is a liquid outlet.

In another embodiment, the system for liquefying production gas from a gas source also has a second cryogenic liquefaction vessel to liquefy the C1-C2 gases separated by the second phase separator. The second cryogenic liquefaction vessel has an inlet and an outlet with the inlet being in fluid communication with the gas outlet of the second phase separator and the outlet being in fluid communication with at least one storage vessel for collection of the liquefied C1-C2 gases.

In an alternate embodiment, the gas outlet of the second phase separator is in fluid communication with a pipeline.

In a further embodiment, the gas outlet of the second phase separator is in fluid communication with a flare stack.

In another embodiment, the first stage of cryogenic liquefaction cools the gas to between −42 and −126 degrees Celsius to cause liquefaction of the C3-C12 production gases.

In another embodiment, the second stage of cryogenic liquefaction cools the gaseous C1-C2 natural gas to at least −162 degrees Celsius to create liquefied C1-C2 natural gas.

In another embodiment, the first stage of cryogenic liquefaction occurs in a first plate exchanger. The second stage of cryogenic liquefaction may occur in a second plate exchanger.

In another embodiment, a sand catcher is positioned between the gas source and the first phase separator. The sand catcher has an inlet in fluid communication with the gas source and a fluid outlet in fluid communication with the inlet of the first phase separator.

In another embodiment, a first pressure relief line is provided between the first phase separator and the first cryogenic liquefaction vessel.

In another embodiment, a second pressure relief line is provided after the gas outlet of the second phase separator.

In another embodiment, the first pressure relief line and the second pressure relief line are in fluid communication with at least one flare stack.

In another embodiment, the system further comprises a 3-phase separator that has an inlet in fluid communication with the at least one alternative outlet of the first phase separator for separation of gas, oil and water.

In one embodiment, a return line is provided between the C1-C2 storage vessels and the second cryogenic liquefaction vessel for reintroducing C1-C2 into the second cryogenic liquefaction vessel.

In one embodiment, a return line is provided between the C1-C2 storage vessels and the first cryogenic liquefaction vessel for reintroducing C1-C2 into the first cryogenic liquefaction vessel.

In one embodiment, a return line is provided between the C3-C12 storage vessels and the first cryogenic liquefaction vessel for the reintroduction of C3-C12 into the first cryogenic liquefaction vessel.

BRIEF DESCRIPTION OF THE DRAWINGS

These and other features will become more apparent from the following description in which references are made to the following drawings, in which numerical references denote like parts. The drawings are for the purpose of illustration only and are not intended to in any way limit the scope of the invention to the particular embodiments shown.

DETAILED DESCRIPTION OF THE PREFERRED EMBODIMENTS

Figure 1:
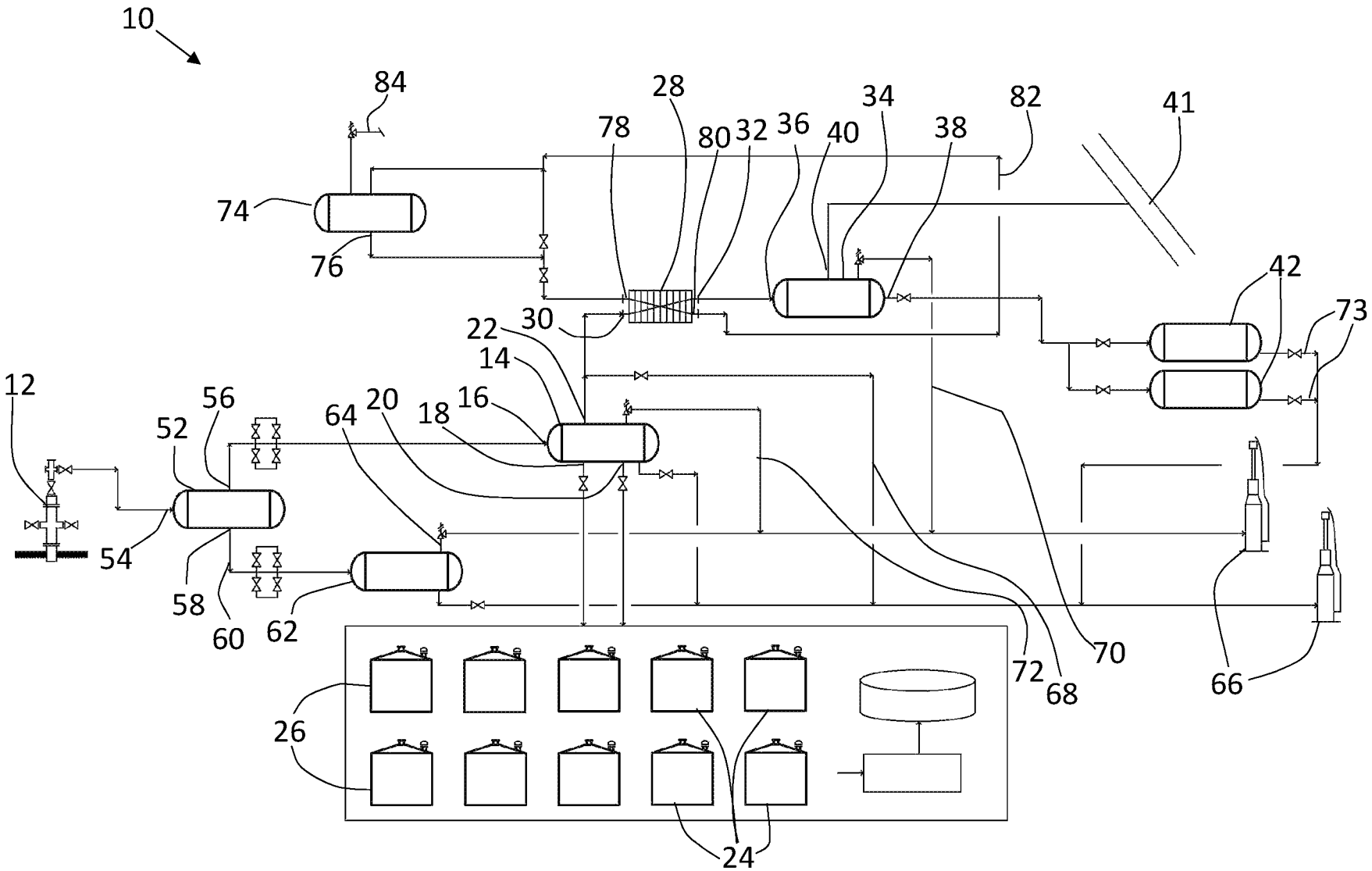
FIG. 1 is a schematic view of a system for liquefying production gas from a gas source.

A system for liquefying production gas from a flow stream contained in a gas source containing that has C1-C12 entrained gases, generally identified by reference numeral 10, will now be described with reference to FIG. 1 through FIG. 3 and FIG. 5 through 6.

Referring to FIG. 1-FIG. 4. C1-C12 production gases are found in many different sources including fluids from wellheads, pipelines and frac fluids. C1-C12 production gases can be separated out of the flow stream contained in gas sources 12. Gas source 12 may be a wellhead, a pipeline or other source from which C1-C12 gases or some of C1-C12 gases may be separated. A 3-phase separator 14 is used to separate the flow stream into water, oil and gas. 3-phase separator 14 has an inlet 16 in fluid communication with gas source 12. 3-phase separator 14 has a water outlet 18, an oil outlet 20 and a gas outlet 22. Water and oil can be transferred to water tanks 24 and oil tanks 26, respectively, while gases are transferred through gas outlet 22 and into a first cryogenic liquefaction vessel 28. The gases that are separated in the 3-phase separator 14 includes C1-C12 production gases. First cryogenic liquefaction vessel 28 has an inlet 30 which is in fluid communication with gas outlet 22 of 3-phase separator and an outlet 32. First cryogenic liquefaction vessel 28 cools the C1-C12 gases to liquefy the C3-C12 petroleum gases and create a fluid containing liquefied C3-C12 petroleum gas and a gaseous C1-C2 natural gas. First cryogenic liquefaction vessel 28 is preferably a plate exchanger, however a person of skill will understand that different types of heat exchangers may be used. Different types of heat exchanges that may be used include, but are not limited to, shell and tube heat exchangers, baffle type heat exchangers, segmental baffles, double segmental baffles, no-tube-in-window baffles, rod baffles, EM baffles, helical baffles, tube enhancements, twisted tubes, low finned tubes, tubes inserts, compact type heat exchangers and plate and frame heat exchangers. In order for the C3-C12 petroleum gases to be liquefied and the C1-C2 gases to remain in gaseous form, the gas in first cryogenic liquefaction vessel is cooled to between −50 and −87 degrees Celsius. The fluid containing liquefied C3-C12 petroleum gas and a gaseous C1-C2 natural gas is passed through a second phase separator 34. In the embodiment shown, second phase separator is a 2-phase separator 34, however it will be understood by a person skilled in the art that a 3-phase separator could also be used. The use of a 3-phase separator would allow for the removal of methanol, water and scavenger that may be introduced to the fluid prior to the fluid passing through second phase separator 34. 2-phase separator 34 has an inlet 36 in fluid communication with outlet 32 of first cryogenic liquefaction vessel 28, a liquid outlet 38 and a gas outlet 40. 2-phase separator 34 separates the C3-C12 liquefied gases from the C1-C2 gases. Storage vessels 42 are provided in fluid communication with liquid outlet 38 of 2-phase separator 34 for the collection of the liquefied C3-C12 petroleum gases.

Figure 2:
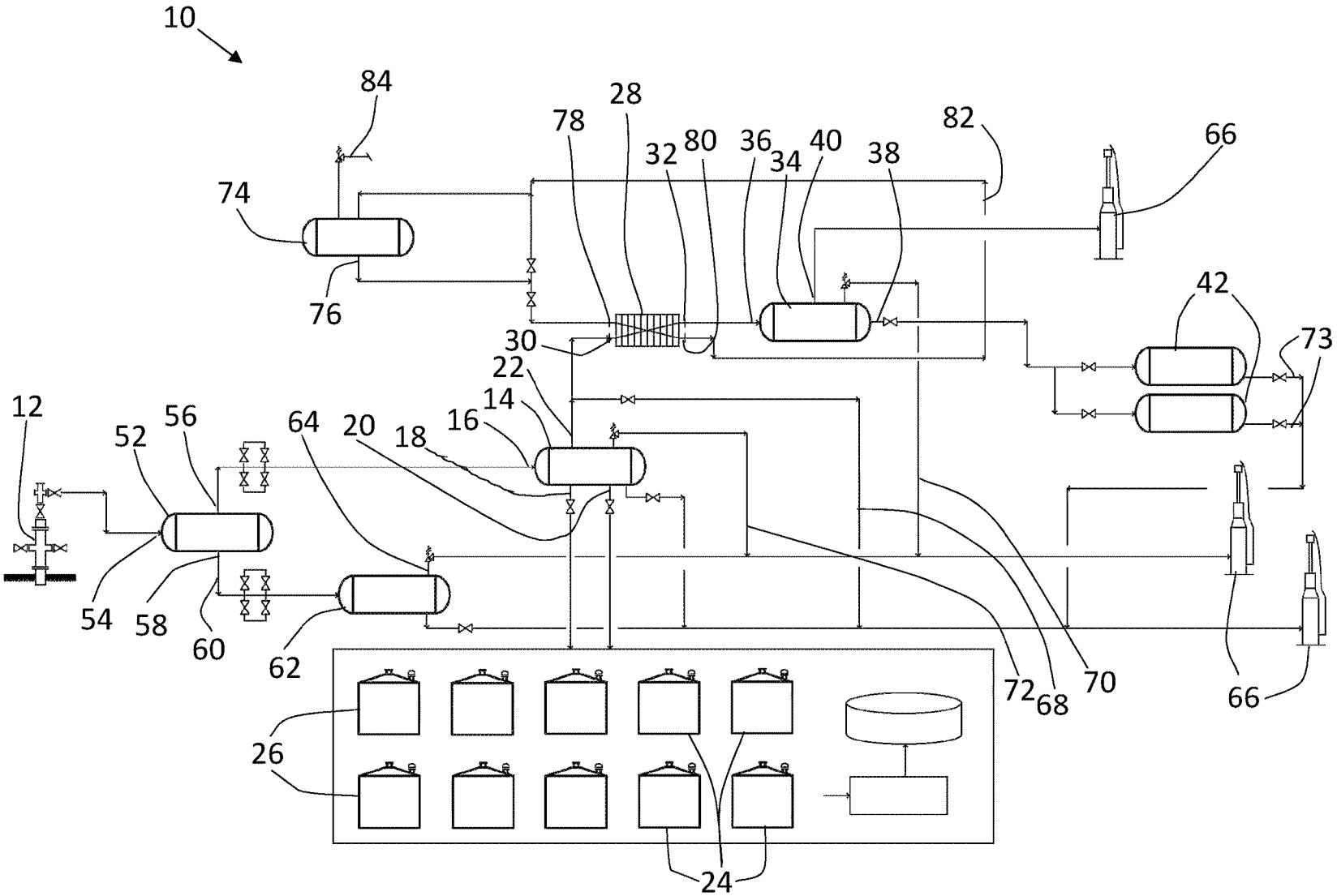
FIG. 2 is a schematic view of a variation of the system for liquefying production gas from a gas source.

After the liquefied C3-C12 petroleum gases have been collected, there are several different options that may be utilized in relation to the C1-C2 natural gases. Referring to FIG. 1, gas outlet 40 of 2-phase separator 34 may be in fluid communication with a pipeline 41 to send the gaseous C1-C2 natural gases into a pipeline system. Referring to FIG. 2, in one alternative, gas outlet 40 of 2-phase separator 34 is in fluid communication with a flare stack 66 where the C1-C2 natural gases are burnt off.

Figure 3:
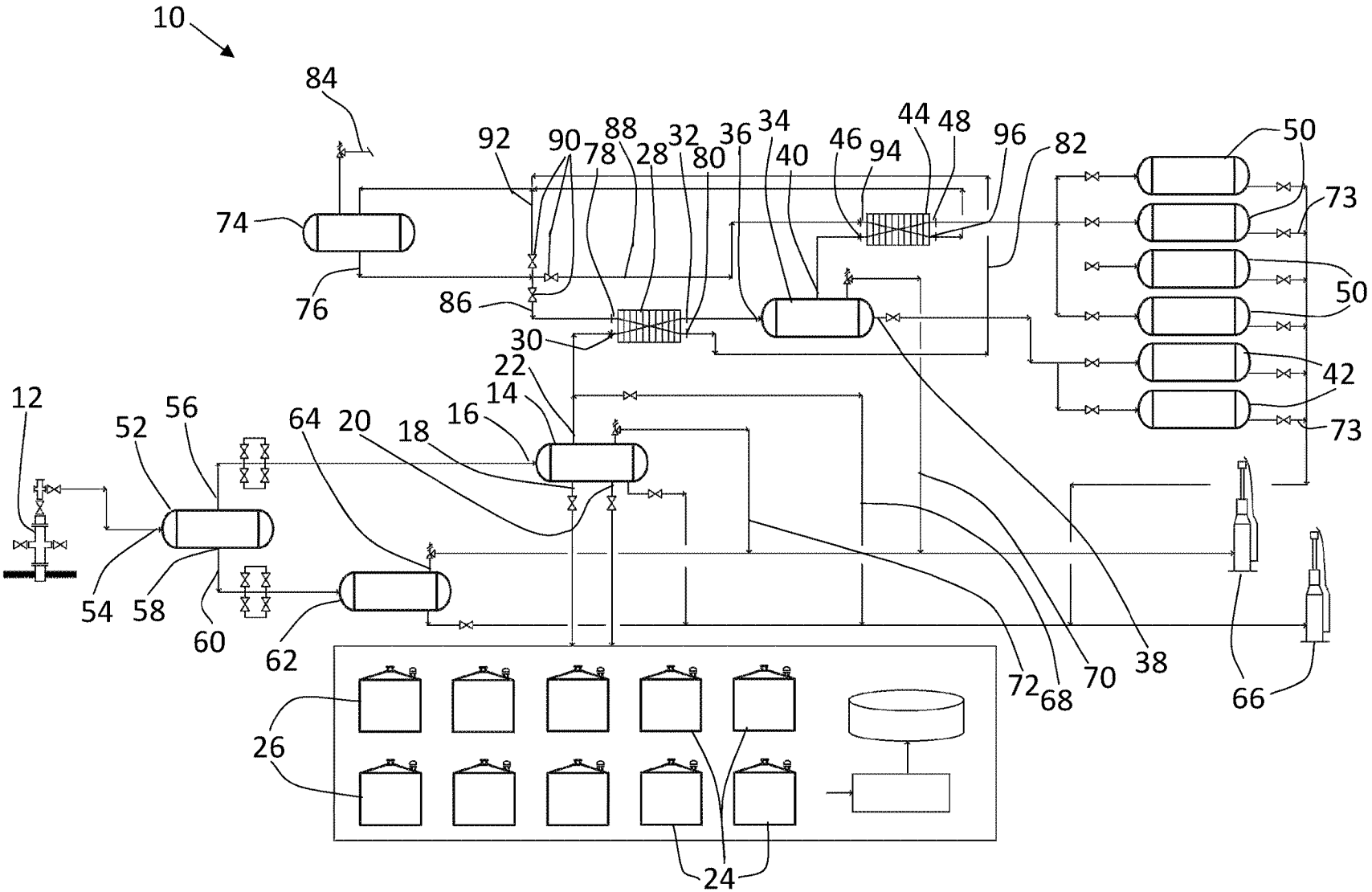
FIG. 3 is a schematic view of a variation of the system for liquefying production gas from a gas source.

Referring to FIG. 3, in the embodiment shown, a second cryogenic liquefaction vessel 44 is provided for liquefying the C1-C2 gases. Second cryogenic liquefaction vessel 44 has an inlet 46 and an outlet 48 with inlet 46 in fluid communication with gas outlet 40 of 2-phase separator 34. Storage vessels 50 for the collection of liquefied C1-C2 gases are provided in fluid communication with outlet 48 of second cryogenic liquefaction vessel 44. In order for the C1-C2 gases to be liquefied, second liquefaction vessel 44 needs to be cooled to at least −162 degrees Celsius. Second cryogenic liquefaction vessel 44 is preferably a plate exchanger, however a person of skill will understand that different types of heat exchangers may be used. Different types of heat exchanges that may be used include, but are not limited to, shell and tube heat exchangers, baffle type heat exchangers, segmental baffles, double segmental baffles, no-tube-in-window baffles, rod baffles, EM baffles, helical baffles, tube enhancements, twisted tubes, low finned tubes, tubes inserts, compact type heat exchangers and plate and frame heat exchangers. Paraffin cutters and methanol may be injected upstream of first cryogenic liquefaction vessel 28 and/or second cryogenic liquefaction vessel 44 to maintain efficient flow through system 10. It will be understood that paraffin cutters and methanol may be injected at other locations within system 10.

Other types of equipment may be included within system 10. This includes a sand catcher 52 which is positioned between gas source 12 and 3-phase separator 14. Sand catcher 52 has an inlet 54 in fluid communication with gas source 12, a fluid outlet 56 in fluid communication with inlet 16 of 3-phase separator 14 and a sand outlet 58. Sand catcher 52 is used to capture sediments that travel with fluid as it exits gas source 12. A blow down line 60 is connected to sand outlet 58 which attaches to a sand storage vessel 62. Sand storage vessel 62 may have a pressure relief line 64 for safety that is connected to a flare stack 66. Where sour gas is a concern, a scavenger may be injected to minimize entrained the sour gas when fluid travels through sand catcher 52. When sand catcher 52 is not used, scavenger may be injected prior to fluid entering 3-phase separator 14. A booster, not shown, may be connected to gas source 12 to increase the volume of fluid that can be drawn out of gas source 12 and sent through system 10. The booster may be a pump which generally increases the pressure of the flow stream from gas source 12. Generally a simpler mechanism which has a single stage of compression may be used and increases the pressure of an already pressurized gas. A two stage booster may also be used. Boosters are beneficial for increasing gas pressure, transferring high pressure gas and charging gas cylinders. Where the flow stream from gas source 12 is primarily gaseous, a compressor may be used to increase the pressure of the gas. A person of skill will understand what types of boosters may be used depending upon the type of gas source being used.

For safety, a first pressure relief line 68 may be provided between 3-phase separator 14 and first cryogenic liquefaction vessel 28. First pressure relief line 68 provides for a means of quickly relieving pressure that may build up when gas exits gas outlet 22 of 3-phase separator 14 before entering inlet 30 of first cryogenic liquefaction vessel 28. First pressure relief line 68 prevents over pressurization of first cryogenic liquefaction vessel 28 in the event of increased gas rates due to well slugging. First pressure relief line 68 is provided in fluid communication with a flare stack 66. A second pressure relief line 70 may be provided on 2-phase separator 34. Second pressure relief line 70 is provided in fluid communication with a flare stack 66. Another pressure relief line 72 may be provided on 3-phase separator 14. A person of skill will understand that sand storage pressure relief line 64, first pressure relief line 68, second pressure relief line 70 and 3-phase separator pressure relief line 72 may be in fluid communication with the same flare stack 66, different flare stacks 66 or multiple flare stacks 66. A number of LNG and LPG storage vessel relief lines 73 are provided on storage vessels 42 and 50 that vent to flare stacks 66 for safety purposes.

Figure 4:
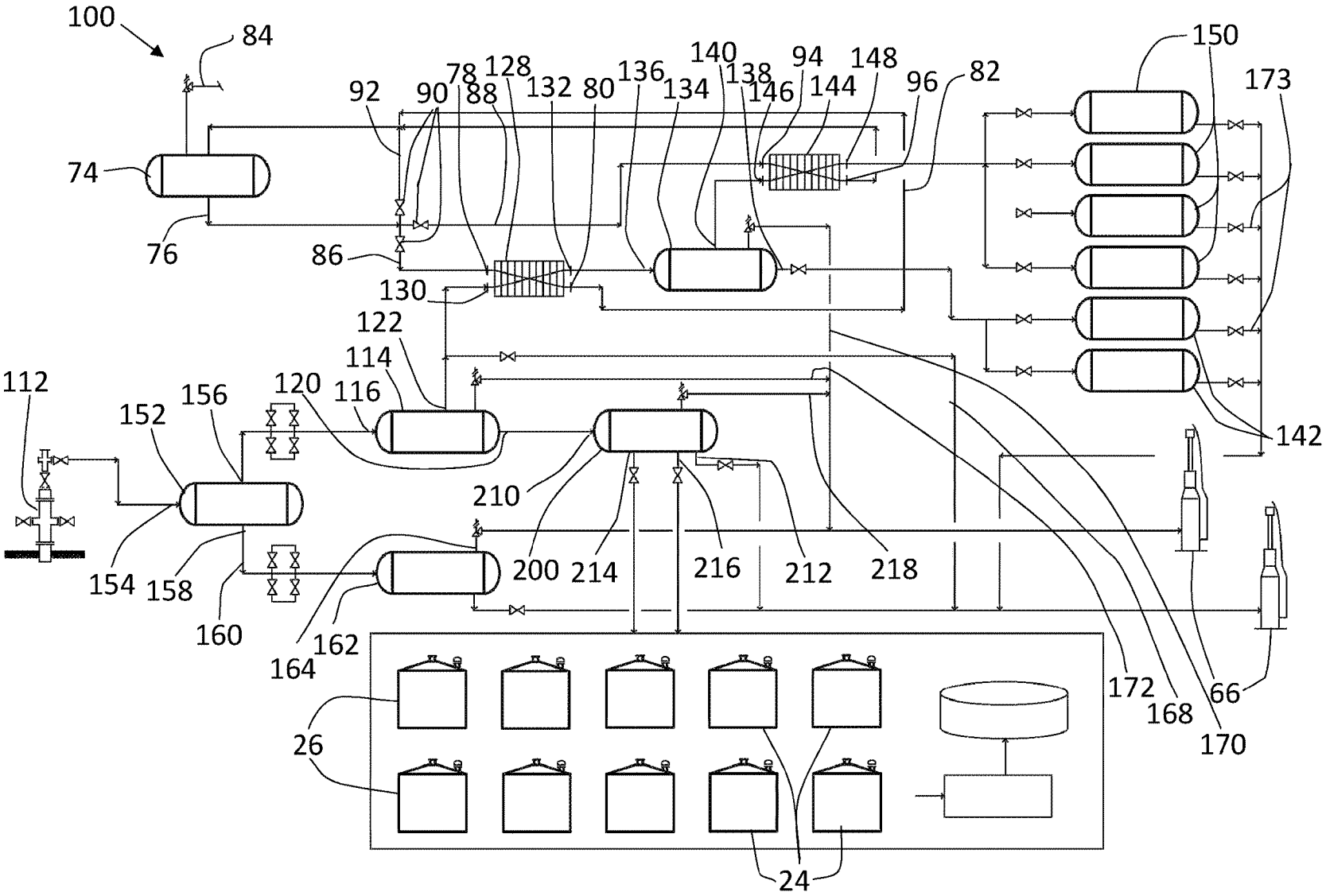
FIG. 4 is a schematic view of a variation of a system for liquefying production gas from a gas source.

First cryogenic liquefaction vessel 28 and second cryogenic liquefaction vessel 44 are preferably cooled using liquid nitrogen. Referring to FIG. 1 and FIG. 2, a nitrogen source 74 such as a liquid nitrogen tank or a nitrogen generator is provided and a nitrogen loop is created through first cryogenic liquefaction vessel 28. Nitrogen is pumped through nitrogen loop using a pump, not shown. Nitrogen travels out of nitrogen source 74 through outlet 76 and into first cryogenic liquefaction vessel 28 through nitrogen inlet 78. The nitrogen cools gases flowing through first cryogenic liquefaction vessel 28 and flows out through nitrogen outlet 80. The nitrogen continues to flow around a nitrogen loop 82 back to nitrogen source 74. Nitrogen source 74 has a nitrogen vent 84 to vent the used nitrogen to the atmosphere. Referring to FIG. 3 and FIG. 4, when second cryogenic liquefaction vessel 44 is included in system 10, nitrogen travels out of nitrogen source 74 through outlet 76 which is split into two inlet lines 86 and 88. Each of inlet lines 86 and 88 are provided with valves 90 to control the flow to first cryogenic liquefaction vessel 28 and second cryogenic liquefaction vessel 44, respectively. A flow line 92 splits off of inlet lines 86 and 88 which connects to nitrogen loop 82 and acts as a pressure relief when necessary with valve 90 being used to control the flow of nitrogen through flow line 92 to nitrogen loop 82. Inlet line 86 is connected to nitrogen inlet 78 of first cryogenic liquefaction vessel 28 and inlet line 88 connects to a nitrogen inlet 94 of second cryogenic liquefaction vessel 44. The nitrogen cools gases flowing through second cryogenic liquefaction vessel 44 and flows out through nitrogen outlet 96. Nitrogen outlet 96 is in fluid communication with nitrogen loop 82 which loops the nitrogen back to nitrogen source 74.

A person of skill will understand that different mediums may be used to cool first cryogenic liquefaction vessel 28 and second cryogenic liquefaction vessel 44. Different types of fluid loops may be used depending upon the method of cooling that is used. It may be beneficial in some instances to use glycol cooled using liquid nitrogen as opposed to liquid nitrogen itself where conditions may cause the nitrogen to be reactive within first cryogenic liquefaction vessel 28 and/or second cryogenic liquefaction vessel 44. Cooling and condensing may also be accomplished by heat exchange with several refrigerant fluids that have successively lower boiling points known as a cascade system. In the alternative, a single refrigerant may be used at several different pressures to provide several temperature levels. A multi-component system which contains several refrigerant components may also be used. A typical combination of refrigerants often includes propane, ethylene and methane. A person of skill will understand that other methods of cooling and condensing may also be used.

Figure 5:
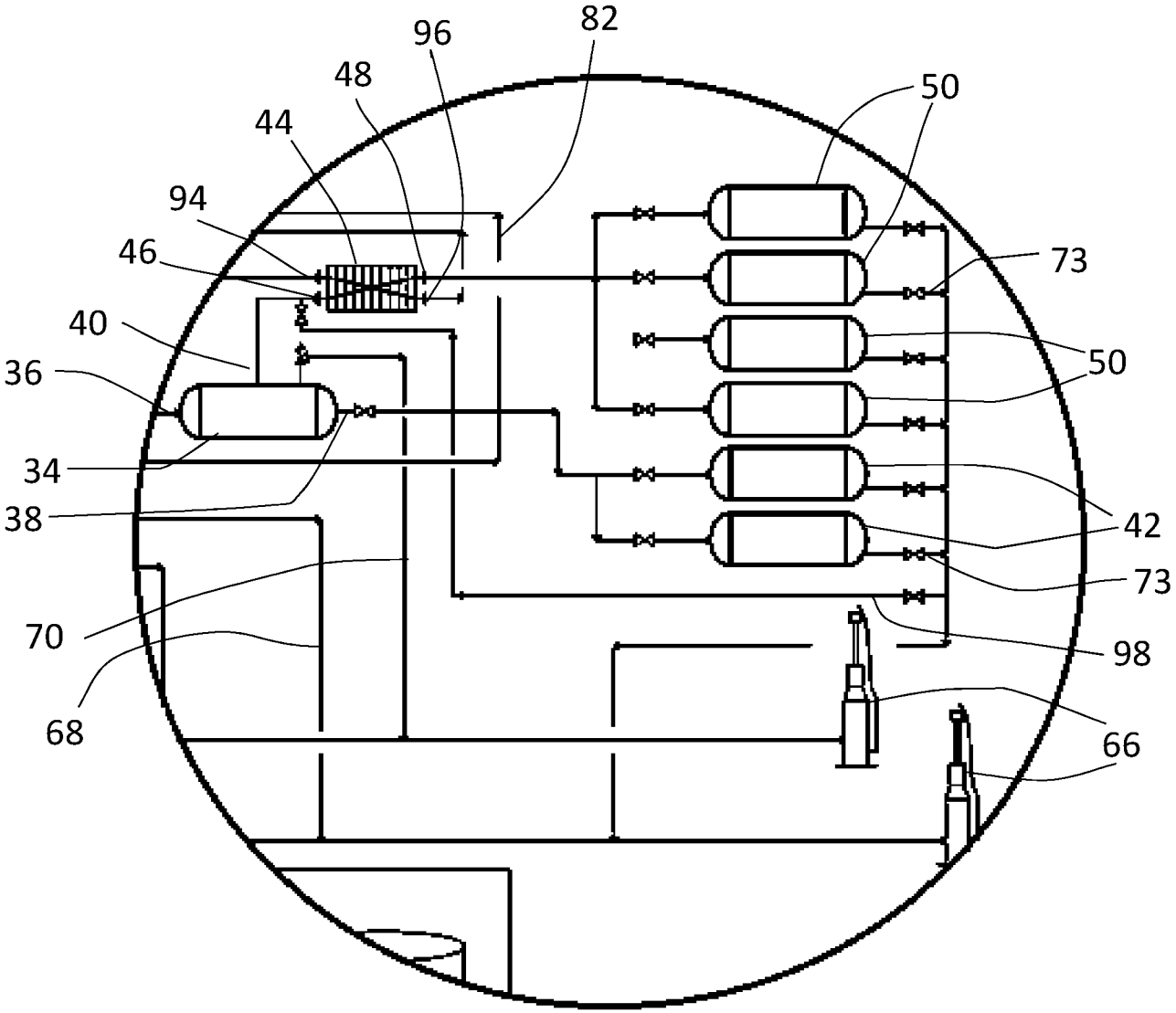
FIG. 5 is a detailed schematic view of a portion of a system for liquefying production gas from a gas source.

Referring to FIG. 5, when C1 and C2 liquefied natural gas is stored within storage vessels 50, gaseous C1 and C2 can be produced as it settles out of the liquefied natural gas. When the Reid vapor pressure (RVP) within storage vessels 50 reaches a predetermined level, storage vessels 50 are depressurized and the C1 and C2 is sent back to inlet 46 and through second cryogenic liquefaction vessel 44 to be reliquefied. C1 and C2 travels through return line 98 from storage vessels 50 to inlet 46 of second cryogenic liquefaction vessel 44. This portion of system 10 is used for RVP stabilization and eliminates the need to flare off or otherwise contain the C1 and C2 gas that can form within storage vessels 50. The Reid vapor pressure at which storage vessels 50 are depressurized may be determined by the user of system 10. One determining factor in determining the level of RVP that depressurization occurs includes spec property quality. If the methane and ethane gas content is too high, it cannot be transported. The methane and ethane gas can be released to lower the RVP within storage vessels 50. Another factor may be determined by end user quality specifications. Different specifications are required for burner tip applications versus combustion requirements.

Figure 6:
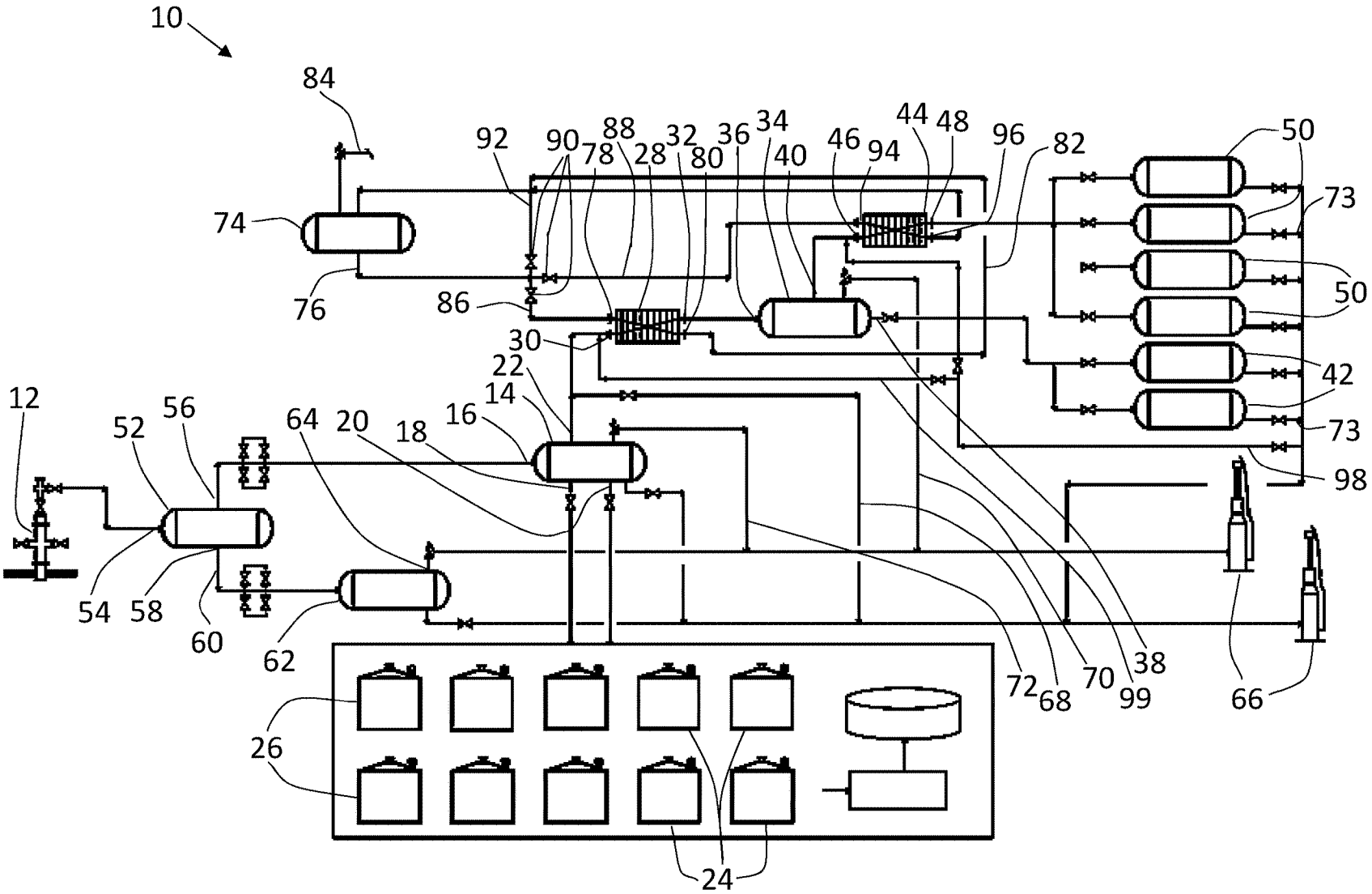
FIG. 6 is a schematic view of a variation of a system for liquefying production gas from a gas source.

Referring to FIG. 6, when the Reid vapor pressure (RVP) within storage vessels 50 reaches a predetermined level, storage vessels 50 are depressurized and the C1 and C2 is sent back to inlet 30 and through first cryogenic liquefaction vessel 28 to be reliquefied. C1 and C2 travels through return line 98 and return line 99 from storage vessels 50 to inlet 30 of first cryogenic liquefaction vessel 28. One potential reason for sending the C1 and C2 through first cryogenic liquefaction vessel 28 is to drop the temperature of gases entering first cryogenic liquefaction vessel 28 which may result in reduced power consumption required during the liquefaction process. In the embodiment shown, return line 98 and return line 99 are provided in fluid communication with each other and flow is determined through the use of valves 90. A person of skill will understand that separate return lines may be provided to send the C1 and C2 to the second cryogenic storage vessel 44 and the first cryogenic storage vessel 28.

When the Reid vapor pressure within storage vessels 42 reaches a predetermined level, storage vessels 42 are depressurized and the C3-C12 is sent back to inlet 30 and through first cryogenic liquefaction vessel 28 to be reliquefied. C3-C12 travels through return line 98 and return line 99 from storage vessels 42 to inlet 30 of first cryogenic liquefaction vessel 28. In the embodiment shown, return line 98 and return line 99 are provided in fluid communication with each other and flow is determined through the use of valves 90. A person of skill will understand that a separate return line may be provided for sending C3-C12 back to first cryogenic liquefaction vessel 28.

By reintroducing the gases from C1-C2 storage tanks 50 and C3-C12 storage tanks 42 into second cryogenic liquefaction vessel 44 and first cryogenic liquefaction vessel 28, the products can be further purified to prevent contamination through entrainment or turbidity that occurs during the process. This works as a "second pass" cleaning. If issues related to high water content occur, gases can be reintroduced downstream of first cryogenic liquefaction vessel 28 and prior to second cryogenic liquefaction vessel 50 to prevent fouling of hydrates caused by the inflow of cold RVP gases re-entering the system.

A boost pump, not shown, may be required to overcome inlet pressures when reintroducing gases into first cryogenic liquefaction vessel 28 and second cryogenic liquefaction vessel 44 from storage tanks 50 and 42.

A variation of the system for liquefying production gas from a gas source containing a flow stream with C1-C12 entrained gases, generally identified by reference numeral 100, will be described with reference to FIG. 4.

A gas source 112 that contains a flow stream with C1-C12 entrained gases is provided in fluid communication with a first phase separator 114. Gas source 12 may be a wellhead, a pipeline or other source from which C1-C12 gases or some of C1-C12 gases may be separated. In the embodiment shown, first phase separator 114 is a 2-phase separator which has an inlet 116 in fluid communication with gas source 112, a gas outlet 122 and a single alternative outlet 120 for fluid.

A person of skill will understand that first phase separator 114 could be a 3-phase separator which separates the fluid from gas source 112 into gas, water and oil. When a 3-phase separator is used, two alternative outlets would be provided, one being a water outlet and the second being an oil outlet. The use of a 3-phase separator is shown in FIG. 1-FIG. 3. Referring to FIG. 4, fluid traveling through alternative outlet 120 may be stored or treated further. Gases from first phase separator 114 are transferred through gas outlet 122 and into a first cryogenic liquefaction vessel 128. First cryogenic liquefaction vessel 128 has an inlet 130 which is in fluid communication with gas outlet 122 of first phase separator and an outlet 132. First cryogenic liquefaction vessel 128 cools the C1-C12 gases to liquefy the C3-C12 petroleum gases and create a fluid containing liquefied C3-C12 petroleum gas and a gaseous C1-C2 natural gas. First cryogenic liquefaction vessel 128 is preferably a plate exchanger, however a person of skill will understand that different types of heat exchangers may be used. In order for the C3-C12 petroleum gases to be liquefied and the C1-C2 gases to remain in gaseous form, the gas in first cryogenic liquefaction vessel 128 is cooled to between −42 and −126 degrees Celsius. The fluid containing liquefied C3-C12 petroleum gas and a gaseous C1-C2 natural gas is passed through a second phase separator 134. In the embodiment shown, second phase separator 134 is a 2-phase separator and has an inlet 136 in fluid communication with outlet 132 of first cryogenic liquefaction vessel 128, a liquid outlet 138 and a gas outlet 140. 2-phase separator 134 separates the C3-C12 liquefied gases from the C1-C2 gases. Storage vessels 142 are provided in fluid communication with liquid outlet 138 of 2-phase separator 134 for the collection of the liquefied C3-C12 petroleum gases. A person of skill will understand that second phase separator 134 may be a 3-phase separator, however at this point in system 100 minimal water can be separated out of fluid.

Fluid traveling through alternative outlet 120 may be passed through a 3-phase separator 200 to separate gas, water and oil. 3-phase separator has an inlet 210 in fluid communication with alternative outlet 120 of first phase separator 128. 3-phase separator 200 has a gas outlet 212, a water outlet 214 and an oil outlet 216. Gas outlet 212 is in fluid communication with a pressure relief line 218 which may direct gas to a flare 66, a pipeline or to first cryogenic liquefaction vessel 128. Since the majority of gas will have been separated out in first phase separator 114, minimal gas should be separated using 3-phase separator 200. Water outlet 214 and oil outlet 216 are provided in fluid communication water tanks 24 and oil tanks 26, respectively.

After the liquefied C3-C12 petroleum gases have been collected, there are several different options that may be made in relation to the C1-C12 natural gases. Gas outlet 140 of second phase separator 134 may be in fluid communication with a pipeline 41, as shown in FIG. 1, or in fluid communication with a flare stack 66 as shown in FIG. 2.

Referring to FIG. 4, in the preferred embodiment, a second cryogenic liquefaction vessel 144 is provided for liquefying the C1-C12 gases. Second cryogenic liquefaction vessel 144 has an inlet 146 and an outlet 148 with inlet 146 in fluid communication with gas outlet 140 of second phase separator 134.

Storage vessels 150 for the collection of liquefied C1-C2 gases are provided in fluid communication with outlet 148 of second cryogenic liquefaction vessel 144. In order for the C1-C2 gases to be liquefied, the gas in second liquefaction vessel 144 needs to be cooled to at least −162 degrees Celsius. Second cryogenic liquefaction vessel 144 is preferably a plate exchanger, however a person of skill will understand that different types of heat exchangers may be used. Paraffin cutters and methanol may be injected upstream of the first cryogenic liquefaction vessel 128 and/or second cryogenic liquefaction vessel 144 to maintain efficient flow through system 100. It will be understood that paraffin cutters and methanol may be injected at other locations within system 100.

Other types of equipment may be included within system 100. This includes a sand catcher 152 which is positioned between gas source 112 and first phase separator 114. Sand catcher 152 has an inlet 154 in fluid communication with gas source 112, a fluid outlet 156 in fluid communication with inlet 116 of first phase separator 114 and a sand outlet 158. Sand catcher 152 is used to capture sediments that travel with fluid as it exits gas source 112. A blow down line 160 is connected to sand outlet 158 which attaches to a sand storage vessel 162. Sand storage vessel 162 may have a pressure relief line 164 for safety that is connected to a flare stack 66. Where sour gas is a concern, a scavenger may be injected to minimize entrained the sour gas when fluid travels through sand catcher 152. When sand catcher 152 is not used, scavenger may be injected prior to fluid entering first phase separator 114. A booster, not shown, may be connected to gas source 112 to increase the volume of fluid that can be drawn out of gas source 112 and sent through system 100. The booster may be a pump which generally increases the pressure of the flow stream from gas source 12. Generally a simpler mechanism which has a single stage of compression may be used and increases the pressure of an already pressurized gas. A two stage booster may also be used. Boosters are beneficial for increasing gas pressure, transferring high pressure gas and charging gas cylinders. Where the flow stream from gas source 12 is primarily gaseous, a compressor may be used to increase the pressure of the gas. A person of skill will understand what types of boosters may be used depending upon the type of gas source being used.

For safety, a first pressure relief line 168 may be provided between first phase separator 114 and first cryogenic liquefaction vessel 128. First pressure relief line 168 provides for a means of quickly relieving pressure that may build up when gas exits gas outlet 122 of first phase separator 114 before entering inlet 130 of first cryogenic liquefaction vessel 128. First pressure relief line 168 prevents over pressurization of first cryogenic liquefaction vessel 128 in the event of increased gas rates due to well slugging. First pressure relief line 168 is provided in fluid communication with a flare stack 66. A second pressure relief line 170 may be provided on second phase separator 134. Second pressure relief line 170 is provided in fluid communication with a flare stack 66. Another pressure relief line 172 may be provided on second phase separator 114. A person of skill will understand that sand storage pressure relief line 164, first pressure relief line 168, second pressure relief line 170 and second phase separator pressure relief line 172 may be in fluid communication with the same flare stack 66, different flare stacks 66 or multiple flare stacks 66. A number of LNG and LPG storage vessel relief lines 173 are provided on storage vessels 142 and 150 that vent to flare stacks 66 for safety purposes.

First cryogenic liquefaction vessel 128 and second cryogenic liquefaction vessel 144 are preferably cooled using liquid nitrogen. A nitrogen source 74 such as a liquid nitrogen tank or a nitrogen generator is provided and a nitrogen loop is created through first cryogenic liquefaction vessel 128. Nitrogen is pumped through nitrogen loop using a pump, not shown. Nitrogen travels out of nitrogen source 74 through outlet 76 and into first cryogenic liquefaction vessel 144 through nitrogen inlet 78. The nitrogen cools gases flowing through first cryogenic liquefaction vessel 144 and flows out through nitrogen outlet 80. The nitrogen continues to flow around a nitrogen loop 82 back to nitrogen source 74. Nitrogen source 74 has a nitrogen vent 84 to vent the used nitrogen to the atmosphere. When second cryogenic liquefaction vessel 144 is included in system 100, nitrogen travels out of nitrogen source 74 through outlet 76 which is split into two inlet lines 86 and 88. Each of inlet lines 86 and 88 are provided with valves 90 to control the flow to first cryogenic liquefaction vessel 128 and second cryogenic liquefaction vessel 144, respectively. A flow line 92 splits off of inlet lines 86 and 88 which connects to nitrogen loop 82 and acts as a pressure relief when necessary with valve 90 being used to control the flow of nitrogen through flow line 92 to nitrogen loop 82. Inlet line 86 is connected to nitrogen inlet 78 of first cryogenic liquefaction vessel 128 and inlet line 88 connects to a nitrogen inlet 94 of second cryogenic liquefaction vessel 144. The nitrogen cools gases flowing through second cryogenic liquefaction vessel 144 and flows out through nitrogen outlet 96. Nitrogen outlet 96 is in fluid communication with nitrogen loop 82 which loops the nitrogen back to nitrogen source 74.

A person of skill will understand that different mediums may be used to cool first cryogenic liquefaction vessel 128 and second cryogenic liquefaction vessel 144. Different types of fluid loops may be used depending upon the method of cooling that is used. It may be beneficial in some instances to use glycol cooled using liquid nitrogen as opposed to liquid nitrogen itself where conditions may cause the nitrogen to be reactive within first cryogenic liquefaction vessel 128 and/or second cryogenic liquefaction vessel 144. Cooling and condensing may also be accomplished by heat exchange with several refrigerant fluids that have successively lower boiling points known as a cascade system. In the alternative, a single refrigerant may be used at several different pressures to provide several temperature levels. A multi-component system which contains several refrigerant components may also be used. A typical combination of refrigerants often includes propane, ethylene and methane. A person of skill will understand that other methods of cooling and condensing may also be used.

Any use herein of any terms describing an interaction between elements is not meant to limit the interaction to direct interaction between the subject elements, and may also include indirect interaction between the elements such as through secondary or intermediary structure unless specifically stated otherwise.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent that changes may be made to the illustrative embodiments, while falling within the scope of the invention. As such, the scope of the following claims should not be limited by the preferred embodiments set forth in the examples and drawings described above, but should be given the broadest interpretation consistent with the description as a whole.

What is claimed is:

1. A system for liquefying production gas from a gas source containing a fluid having C1-C12 entrained gases, comprising:

a first phase separator for separating C1-C12 gases from the fluid from the gas source, the first phase separator having an inlet in fluid communication with the gas source, a gas outlet and at least one alternative outlet;

a first cryogenic liquefaction vessel having an inlet and an outlet, the inlet being in fluid communication with the gas outlet of the first phase separator, the first cryogenic liquefaction vessel being configured and disposed within the system such that the C1-C12 gases can be cooled to a temperature between −50 degrees Celsius and −87 degree Celsius to liquefy C3-C12 petroleum gases;

a second phase separator for separating the liquified C3-C12 petroleum gases from the C1-C2 gases, the second phase separator having an inlet, a liquid outlet and a gas outlet, the inlet being in fluid communication with the outlet of the first cryogenic liquefaction vessel;

at least one storage vessel in fluid communication with the liquid outlet of the second phase separator for collection of the liquefied C3-C12 petroleum gases.

2. The system of claim 1 wherein the first phase separator is a three-phase separator for separating the fluid into water, oil and gas during operation of the system and the alternative outlet is a liquid outlet.

3. The system of claim 1 further comprising a second cryogenic liquefaction vessel for liquefying the C1-C2 gases, the second cryogenic liquefaction vessel having an inlet and an outlet, the inlet being in fluid communication with the gas outlet of the second phase separator and the outlet being in fluid communication with at least one storage vessel for collection of the liquefied C1-C2 gases.

4. The system of claim 3 wherein the gases in the second cryogenic liquefaction vessel are cooled to at least −162 degrees Celsius during operation of the system.

5. The system of claim 3 wherein the second cryogenic liquefaction vessel is a second plate exchanger.

6. The system of claim 3 wherein a return line is provided between the C1-C2 storage vessels and the second cryogenic liquefaction vessel for reintroducing C1-C2 into the second cryogenic liquefaction vessel.

7. The system of claim 3 wherein a return line is provided between the C1-C2 storage vessels and the first cryogenic liquefaction vessel for reintroducing C1-C2 into the first cryogenic liquefaction vessel.

8. The system of claim 1 wherein the gas outlet of the second phase separator is in fluid communication with a pipeline.

9. The system of claim 1 wherein the gas outlet of the second phase separator is in fluid communication with a flare stack.

10. The system of claim 1 wherein the first phase separator is a three-phase separator for separating the fluid from the gas source into water, oil and gas during operation of the system, and the at least one alternative outlet comprises a water outlet and an oil outlet, the water outlet being in fluid communication with a water tank such that the water is transferrable from the first phase separator, via the water outlet, to the water tank, and the oil outlet being in fluid communication with an oil tank such that the oil is transferrable from the first phase separator, via the oil outlet, to the oil tank.

11. The system of claim 1 wherein the first cryogenic liquefaction vessel is a first plate heat exchanger.

12. The system of claim 1 wherein a sand catcher is positioned between the gas source and the first phase separator, the sand catcher having an inlet in fluid communication with the gas source and a fluid outlet in fluid communication with the inlet of the first phase separator.

13. The system of claim 1 wherein a first pressure relief line is provided between the first phase separator and the first cryogenic liquefaction vessel.

14. The system of claim 1 wherein a second pressure relief line is provided on the second phase separator.

15. The system of claim 14 wherein a first pressure relief line is provided between the first phase separator and the first cryogenic liquefaction vessel, and the first pressure relief line and the second pressure relief line are in fluid communication with at least one flare stack.

16. The system of claim 1 further comprising a three-phase separator having an inlet in fluid communication with the at least one alternative outlet of the first phase separator for separation of gas, oil and water.

17. The system of claim 1 wherein a return line is provided between the C3-C12 storage vessels and the first cryogenic liquefaction vessel for reintroducing C3-C12 into the first cryogenic liquefaction vessel.

* * * * *